United States Patent [19]

Regenos et al.

[11] 4,001,837

[45] Jan. 4, 1977

[54] DUAL SCAN CORNER REFLECTOR ANTENNA

[75] Inventors: Kenneth M. Regenos, Palo Alto; Normand Barbano, Sunnyvale, both of Calif.

[73] Assignee: The United States of America as represented by the Secretary of the Army, Washington, D.C.

[22] Filed: Jan. 9, 1976

[21] Appl. No.: 647,694

[52] U.S. Cl. ..... 343/815; 343/854

[51] Int. Cl.[2] ..... H01Q 3/26; H01Q 19/16

[58] Field of Search ..... 343/814, 815, 835, 854

[56] References Cited

UNITED STATES PATENTS

| | | | |
|---|---|---|---|
| 3,039,097 | 6/1962 | Strumwasser et al. | 343/854 |
| 3,202,997 | 8/1965 | Schell | 343/854 |

*Primary Examiner*—Eli Lieberman

*Attorney, Agent, or Firm*—Nathan Edelberg; Robert P. Gibson; Freddie M. Bush

[57] ABSTRACT

The dual scan corner reflector antenna is a frequency scanned antenna for radar, direction finding, or guidance systems which provides increased information gathering capacity over that of prior art systems. The antenna utilizes a helix frequency scanning feed to drive a dipole antenna array. Each output port of the feed is connected to a power divider or combiner to form a common line to the antenna element. At each end of the helix frequency scanning feed are hybrid terminals used to simultaneously form two receive or transmit radiation patterns. The respective helix feed couplers have symmetrical values about the center of the helix feed, allowing the two radiation patterns to be mirror images of each other at the same frequencies. These two radiation patterns can be scanned simultaneously and independently.

4 Claims, 17 Drawing Figures

$f_1$ $f_c$ $f_2$ $f_1$ $f_c$ $f_2$

PORT 31, $f_1$
PORT 35, $f_2$

PORT 31, $f_c$
PORT 35, $f_c$

PORT 31, $f_2$
PORT 35, $f_1$ $f_1$ $f_3$ $f_c$ $f_4$ $f_2$

DUAL SCAN CORNER REFLECTOR ANTENNA

DEDICATORY CLAUSE

The invention described herein was made in the course of or under a contract or subcontract thereunder with the Government and may be manufactured, used, and licensed by or for the Government for governmental purposes without the payment to us of any royalties thereon.

BACKGROUND OF THE INVENTION

The dual scan corner reflector antenna provides a frequency scan array. Frequency scanning methods are used where rapid and accurate target tracking data is required, often including plural, dispersed targets which must be followed. Frequency scanning allows a portion or all of the regions scanned to be covered by changes in the radiated beam frequency. This allows electronic beam steering to occur, overcoming limitations inherent in cumbersome mechanical beam steering systems. Corner reflectors and frequency scanning arrays are disclosed in more detail in the literature. "Radar Handbook" by M. I. Skolnik, McGraw-Hill Book Company, 1970, provides such teaching. Particular attention to the subject of frequency scanning techniques is provided in chapter 13 thereof.

SUMMARY OF THE INVENTION

The dual scan corner reflector antenna forms two radiation patterns whose main beams can be scanned simultaneously and independently. Information from each of the patterns is available at separate outputs of the antenna system for processing or generation. The main beams are frequency scanned, and the instantaneous scanning frequencies and rate of scan may or may not be independent of each other. All known prior art frequency scanned antennas form only one frequency scanned beam in a given plane at a time. The dual scan antenna uses a helix frequency scanning feed delay line to drive an antenna array. Each output port of the helix frequency scanning feed is connected to a power divider or combiner to form a common line to dipole antenna elements. Hybrid terminals are used to simultaneously form the two receive or transmit radiation patterns. The couplers of the helix feeds are disposed to provide symmetrical values about the center of the helix feed, thereby allowing the two radiation patterns developed on the antenna elements to be mirror images of each other at the same frequencies.

DESCRIPTION OF THE PREFERRED EMBODIMENT

The dual scan corner reflector antenna provides a frequency scanning antenna system that can be fed from both ends and hence scan both clockwise and counterclockwise with increasing frequency simultaneously. This allows the cancelling of most systematic errors in the antenna beam forming structure by suitable signal processing. It provides for more efficient use of the antenna by providng two beams capable of independent operation.

The frequency scanning corner reflector antenna may be constructed from sheet metal or a wire screen grid with grid spacings determined by the maximum frequency of operation. A shielded helix delay line feed for the system may be provided in one unit or in small sections for ease of handling. Since the antenna is primarily a passive structure, a highly reliable system results. The antenna provides two modes of operation for the elevation beam, monopulse and sequential lobing. The radiation patterns are horizontally polarized, and the main lobe is scanned in azimuth by changing the operating frequency.

Figure 1:
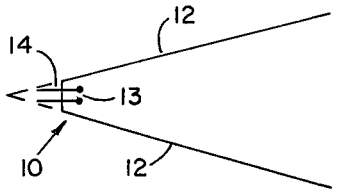
FIG. 1 is a simplified diagrammatic top view of a dual scan corner reflector antenna.

Referring now to the drawings wherein like numbers represent like parts, FIG. 1 discloses a top or plane view of a corner reflector 10 comprising two planar surfaces 12 having an acute included angle therebetween. A dipole array 13 is disposed in the throat 14 of reflector 10 for transmitting and receiving radiation.

Figure 2:
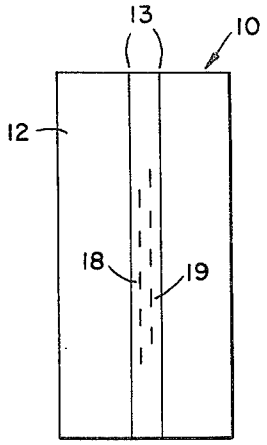
FIG. 2 is a diagrammatic front view of the antenna of FIG. 1 showing the arrangement of the dipole antenna elements.

As shown in FIG. 2, dipole array 13 is comprised of two columns of antenna elements 18 and 19, with each element being staggered with respect to other elements so that only one antenna element lies in a given horizontal plane. The position of the dipoles from the bisector of the corner reflector influences the elevation radiation pattern performance. A ground plane, not shown, behind the dipole array will shape the element patterns and prevent a trapped wave from developing between the dipole elements and the rear corner or throat of the antenna. This reduces ripple on the main lobe and prevents or reduces high side lobes at right angles to the main beam.

Figure 3:
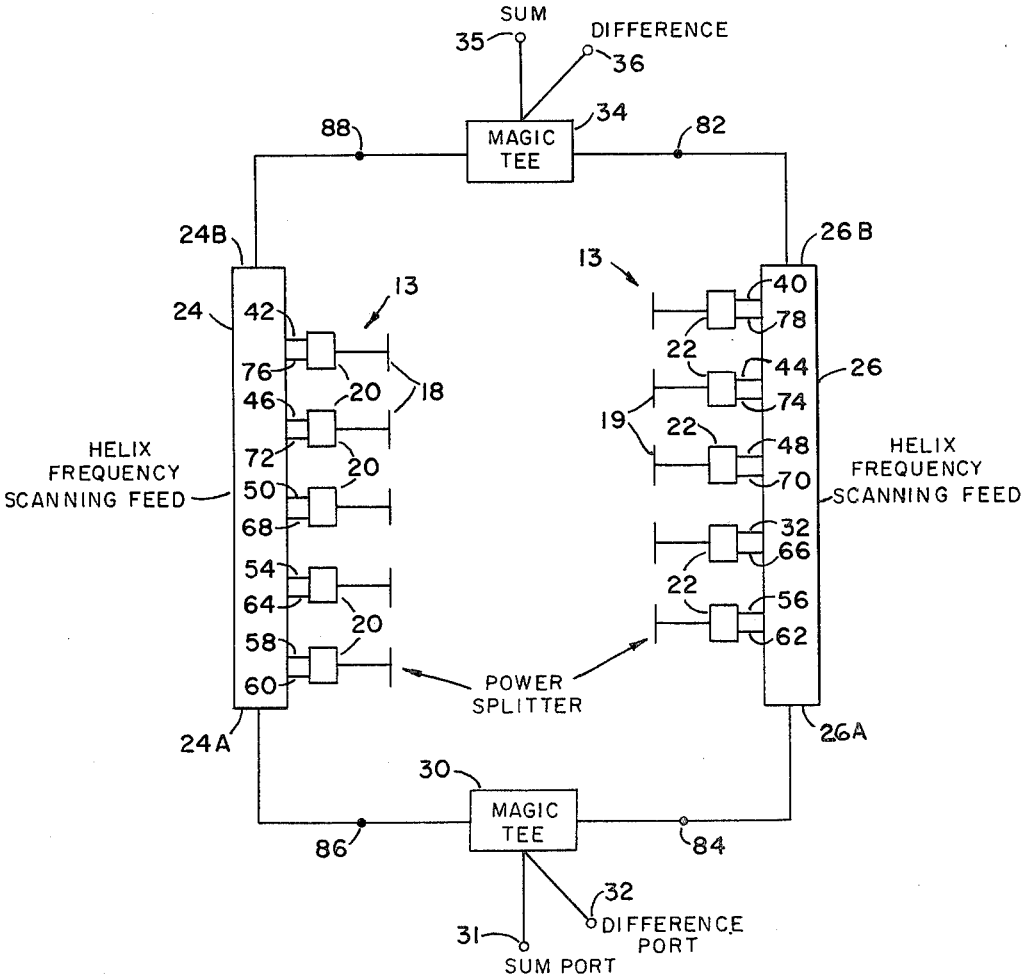
FIG. 3 is a schematic diagram of the beam forming network of the antenna for providing an azimuth dual beam mode and an elevation monopulse mode of operation.

In the schematic of FIG. 3, dipole array 13 is shown with each of the dipole elements 18 connected to respective power splitters 20, and dipole elements 19 connected to respective power splitters 22. Power splitters 20 are connected to respective coupler output pairs on a helix frequency scanning feed 24. The other power splitters 22 are similarly connected to coupler output pairs on a helix frequency scanning feed 26. Thus, both columns of dipoles are fed from a helix to provide the antenna dual beam scanning mode of operation. One common end 24A and 26A of each helix are coupled to a hybrid junction or magic tee 30 for providing a sum and difference pattern output for monopulse operation in the elevation plane. Another common end 24B and 26B of each helix are coupled to a hybrid junction such as magic tee 34 for providing the sum and difference pattern output.

Power splitters 20 and 22 are respectively matched 3-db power dividers each having two equal power ports. The two equal power ports of the respective power dividers are connected through equal length coaxial cables to a diametrically opposite pair of coupler terminals (not shown) along the respective helix delay line. Each dipole is in line with the pair of couplers to which it is connected so that the separation between dipole elements is the same as the coupler separation.

In operation of the antenna, on the axis, to form a single beam in elevation, either sum port 31 or sum port 35 is excited with an input signal. Sum port 35 and difference port 36 are coupled through the helix feed in power splitters to the same side of each antenna element. Similarly, sum port 31 and difference port 32 are coupled through the other side of respective antenna elements. This allows the generated beam to scan clockwise with an increase in frequency at one port and to scan counterclockwise with an increase in frequency from the other port. Thus, assuming either sum port 35 or difference port 36 is excited to provide a clockwise scan, the power is equally divided between helix scanning feeds 24B and 26B. As the signal power is advanced through the helix feeds 24 and 26, input signals are coupled to the antenna elements through respective coupler inputs 40, 42, 44, 46, 48, 50, 52, 54, 56, and 58 to the power splitters. As the center frequency of operation the signals at each dipole element are in phase and the generated beam is located broadside to the antenna aperture. Thus there is a zero degree shift at the center frequency. As the input frequency is lowered to a lower limit or increased to an upper limit the beam will scan in either direction from broadside or zero degrees. A 30° azimuth sector can be efficiently scanned without mechanically moving the antenna array. The elevation pattern over the sector is essentially the summing beam when the antenna assembly is excited from sum port 35. Similary, the difference beam scan is excited by feeding difference port 36.

Feeding sum port 31 or difference port 32 provides a similar monopulse pattern which is scanned in the opposite direction. The feed in this case is divided by magic tee 30 and is coupled sequentially to the power splitters and antenna elements through coupler ports 60, 62, 64, 66, 68, 70, 72, 74, 76, and 78.

For generating a sequential lobing pattern, a 45° phase shift is introduced between the input to the helix feed and the output of the hybrid. A 45° phase shifter would be disposed at points 82, 84, 86, and 88 between the outputs of hybrids 34 and 30 and the respective inputs of helix feeds 26 and 24. Typically, an upper sequential lobing beam is formed by adding the 45° phase delay at points 82 and 84 on the input of helix 26. Similarly, adding the 45° phase delay at points 86 and 88 forms the lower sequential lobing beam. For sequential lobing, input signals are fed only into the sum ports.

Figure 4:
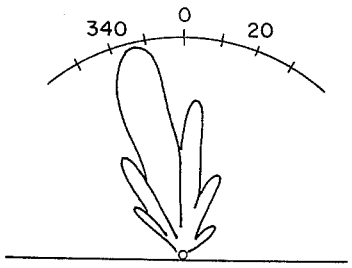
FIGS. 4, 5 and 6 are azimuth sum beam radiation patterns for low, center, and high frequency input levels at sum port 31 across the radiation band.
Figure 5:
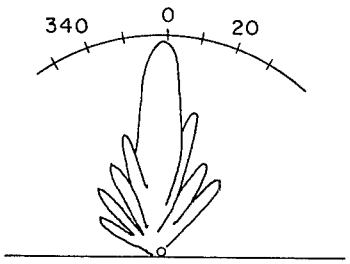
Figure 6:
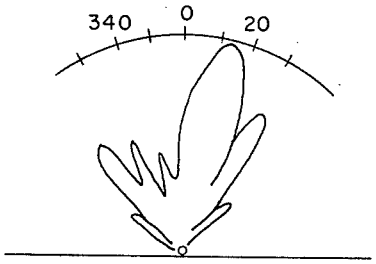

Radiation patterns for individual and dual beam scanning modes are shown in FIGS. 4–17. The first set of patterns shown in FIGS. 4, 5 and 6 result with only microwave energy coupled to sum port 31. Only a single beam is formed. The beam is scanned clockwise with increasing frequency. This direction is away from the feed end. FIG. 4 shows the direction of radiation pattern at the lower end of the frequency band, with $f_1$ representing the lower frequency which is radiated approximately 15° counterclockwise of zero degrees. At the center frequency $f_c$, shown in FIG. 5, the beam is radiated broadside or substantially normal to the throat of the antenna and the radiation direction is shown to occur at zero degrees. At the upper end of the band $f_2$ (FIG. 6) shows the pattern to be scanned to approximately 15° clockwise of zero degrees.

Figure 7:
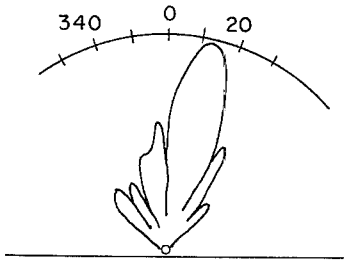
FIGS. 7, 8 and 9 are azimuth sum beam radiation patterns for low, center, and high frequency input levels across the radiation band for sum port 35.
Figure 8:
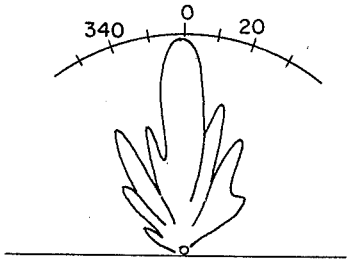
Figure 9:
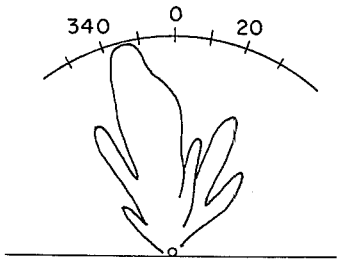

The radiation pattern with the generator input only at sum port 35 is shown in FIGS. 7, 8 and 9. These patterns are substantially mirror images of those in FIGS. 4, 5 and 6 respectively. The exactness of the image depends upon the relative amplitude and phase matches between the circuits that feed the two rows of dipoles. The beam shown in FIGS. 7, 8 and 9 scan a counterclockwise direction with increasing frequency respectively.

Figure 10:
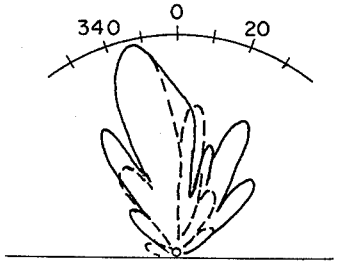
FIGS. 10, 11 and 12 are azimuth dual beam radiation patterns for simultaneous frequency input levels from both sum ports of the antenna.
Figure 11:
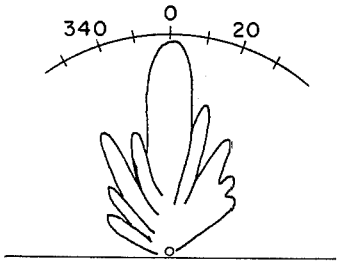
Figure 12:
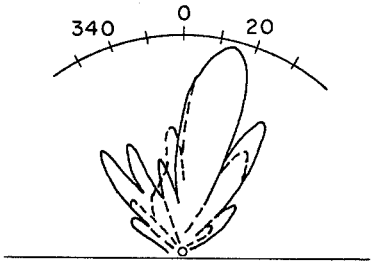
Figure 13:
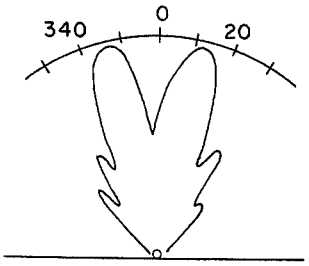
FIGS. 13, 14, 15, 16 and 17 are azimuth dual-sum beam radiation patterns for simultaneous input levels of the same frequency from both sum ports of the antenna.

The next set of radiation patterns show the results when both sum ports 31 and 35 are fed simultaneously. The frequencies coupled to the antenna assembly are such that the direction of the two main lobes are substantially coincident. Thus, FIG. 10 discloses the radiation pattern with port 31 having the lower frequency $f_1$ coupled therethrough and port 35 having the upper frequency $f_2$ coupled therethrough. FIGS. 10, 11 and 12 show that there is virtually no interference between the two radiation patterns and that each pattern solely resembles the patterns with one hybrid activated at a time. At broadside, where each generator is set at the center frequency $f_c$, only a small amount of modulation is observed on the pattern envelope of FIG. 11. FIG. 12 shows the opposite condition to FIG. 11, with port 31 receiving $f_2$ and port 35 receiving $f_1$.

Figure 14:
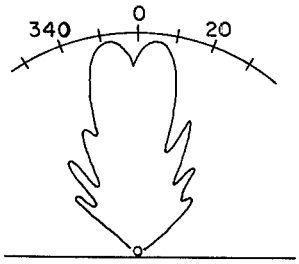
Figure 15:
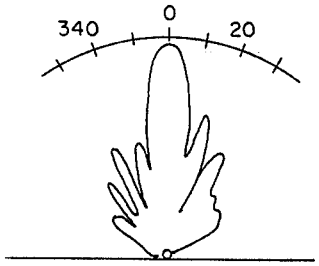
Figure 16:
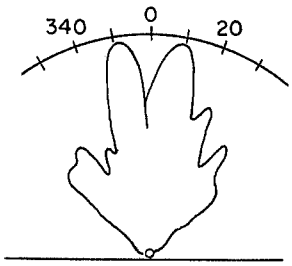
Figure 17:
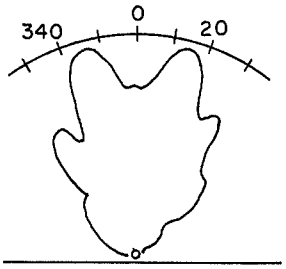

FIGS. 13, 14, 15, 16 and 17 show the other extreme case where the antenna is operated in the dual-beam scanning mode with both sum inputs receiving the same frequency simultaneously. Separate and distinct lobing is observed in all of these figures except FIG. 15 where $f_c$ is common to both inputs. FIGS. 14 and 16 show the radiation pattern for additional input frequencies $f_3$ and $f_4$. These frequencies are intermediate of the limit frequencies $f_1$ and $f_2$ and show the radiation pattern obtained with the frequencies nearer $f_c$. Again there is no evidence of interference between the two patterns.

Although a particular embodiment and form of this invention has been illustrated, it is obvious to those skilled in the art that modifications may be made without departing from the scope and spirit of the foregoing disclosure. For example, it is obvious that the 45° phase shifters necessary for generating a sequential lobing pattern may be inserted at points 82, 84, 86, and 88 of FIG. 3. Similarly, it should be obvious that these phase shifters may be actually disposed in a separate line for coupling to the respective helix feeds with appropriate switching provided between the two feed systems. Therefore, it is understood that the invention is limited only by the claims appended hereto.

We claim:

1. A dual scan corner reflector antenna beam forming network comprising: first and second planar microwave reflector surfaces disposed for forming a throat at an acute angle therebetween, a plurality of dipole antennas uniformly disposed in said throat for radiating and receiving microwave energy, a first helix frequency scanning feed coupled to a first portion of said dipole antennas for coupling microwave energy thereto, a second helix frequency scanning feed coupled to a second portion of said dipole antennas for coupling microwave energy thereto, first and second hybrid junctions coupled to both of said helix feeds for coupling microwave energy to and from respective ends of said feeds for providing simultaneous and independent radiation scanning operation of said antenna.

2. A dual scan corner reflector antenna as set forth in claim 1 wherein said dipole antennas are disposed in two adjacent columns with individual dipole elements of each column being staggered with respect to other dipole elements so that each dipole is in a different horizontal plane, said dipole elements and helix feeds being coupled to provide frequency scanning simultaneously in a clockwise and a counterclockwise direction.

3. A dual scan corner reflector antenna as set forth in claim 2 and further comprising a power splitter coupled between each dipole element and respective output ports of said helix frequency scanning feeds for forming a common line between the dipole elements and the respective helix.

4. A dual scan corner reflector antenna as set forth in claim 3 wherein said hybrid junctions are magic tee hybrids having first and second input-output ports, a sum port, and a difference port for coupling microwave energy therethrough, said first and second ports of said first magic tee being coupled to a first end of said first and second helix feeds respectively, and said first and second ports of said second magic tee being coupled to a second end of said first and second helix feeds respectively for providing said simultaneous and independent radiation scanning.

* * * * *